US007540891B2

(12) United States Patent
Van Den Born et al.

(10) Patent No.: US 7,540,891 B2
(45) Date of Patent: Jun. 2, 2009

(54) SYSTEM AND METHOD FOR STRIPPING TOXIGAS FROM A POWDER

(75) Inventors: Isaac Cornelis Van Den Born, Amsterdam (NL); Johannes Gerardus Maria Schilder, Amsterdam (NL)

(73) Assignee: Shell Oil Company, Houston, TX (US)

( * ) Notice: Subject to any disclaimer, the term of this patent is extended or adjusted under 35 U.S.C. 154(b) by 287 days.

(21) Appl. No.: 10/577,478

(22) PCT Filed: Oct. 29, 2004

(86) PCT No.: PCT/EP2004/012257

§ 371 (c)(1),
(2), (4) Date: Dec. 4, 2006

(87) PCT Pub. No.: WO2005/049769

PCT Pub. Date: Jun. 2, 2005

(65) Prior Publication Data

US 2007/0084117 A1 Apr. 19, 2007

(30) Foreign Application Priority Data

Oct. 31, 2003 (EP) ..... 03104040

(51) Int. Cl.
*C10H 1/00* (2006.01)

(52) U.S. Cl. ..... 48/24; 95/275; 55/474; 48/197 R

(58) Field of Classification Search ..... 48/24, 48/89, 128, 197 R; 55/474; 95/274, 275; 422/147, 189, 213
See application file for complete search history.

(56) References Cited

U.S. PATENT DOCUMENTS

| | | | | |
|---|---|---|---|---|
| 4,516,989 | A * | 5/1985 | Mink et al. | 95/271 |
| 4,838,898 | A | 6/1989 | Mifflin et al. | 48/210 |
| 5,017,196 | A | 5/1991 | Dewitz | 48/210 |
| 5,143,521 | A * | 9/1992 | Dewitz | 48/210 |
| 5,232,466 | A * | 8/1993 | Dewitz | 48/77 |
| 5,922,090 | A * | 7/1999 | Fujimura et al. | 48/197 R |

FOREIGN PATENT DOCUMENTS

| | | |
|---|---|---|
| DE | 2512315 | 2/1976 |
| DE | 3436581 | 4/1986 |
| DE | 4115824 | 11/1992 |
| EP | 0308025 | 3/1989 |
| EP | 0370201 | 5/1990 |

OTHER PUBLICATIONS

International Search Report PCT/EP2004/012257 dated Feb. 23, 2005.

* cited by examiner

*Primary Examiner*—Duane S Smith
*Assistant Examiner*—Sonji Turner

(57) ABSTRACT

A system and method for removal of a toxic gas from a powder contaminated with the toxic gas. The system comprises:

a source of the contaminated powder;

a stripper assembly for stripping at least part of the toxic gas from a batch load of the contaminated powder;

connecting means for fluidly connecting the source with the stripper assembly for transporting the contaminated powder from the source to the stripper assembly. The stripper assembly may comprise two or more stripper vessels, and the connecting means is arranged to selectively connect the source to one or more of the stripper vessels. Gravity-driven transport of the contaminated powder from the source of the contaminated powder to the stripper assembly may be established. The source may comprise a gasifier and a depressurising chamber.

28 Claims, 2 Drawing Sheets

SYSTEM AND METHOD FOR STRIPPING TOXIGAS FROM A POWDER

PRIORITY CLAIM AND CROSS REFERENCE

The present application is a 35 U.S.C. 371 national stage filing of PCT/EP2004/012257 filed 29 Oct. 2004, which claims benefit of European patent application No. 03104040.5 filed 31 Oct. 2003.

Field of the Invention

The present invention relates to systems for removal of a toxic gas from a powder contaminated with the toxic gas, and to methods of de-toxicating a powder contaminated with a toxic gas.

Such systems and methods may be used in a dry solids removal system of a coal gasification plant.

BACKGROUND OF THE INVENTION

In a coal-gasification plant a pulverised carbonaceous fuel, such as coal, is transformed into a product gas consisting mainly of synthesis gas. The gasification plant typically comprises a gasification reactor, or gasifier, wherein the pulverised carbonaceous fuel is gasified under high pressure and high temperature conditions. The synthesis gas leaving the gasifier may carry along with it fly ash or fly slag, or ash-forming constituents which may consist of alkali metal chlorides, silicon and/or aluminium oxides. For the purpose of this specification, all such solid particulates entrained with the synthesis gas are referred to with the term fly ash.

In order to obtain a clear product gas, the unwanted fly ash can be separated from the gas stream on the high-pressure and high-temperature side of the gasification plant, then depressurised and cooled prior to disposal. A minor amount of residual synthesis gas can be carried by, entrained with or absorbed on the fly ash. To remedy this undesirable situation, the fly ash must be detoxified prior to disposal. In particular, residual synthesis gas must be stripped from the fly ash.

An apparatus and method for removal and disposal of fly ash from a high-temperature, high-pressure synthesis gas stream has been proposed in U.S. Pat. No. 4,838,898. This US patent describes fly ash being separated from a stream of synthesis gas coming from a gasifier at high temperature and high pressure. A batch of the fly ash is collected using a separator in the form of a cyclone separator. The batch is subsequently sluiced down to ambient pressure in a lock hopper. From the lock hopper, the batch is transported to a stripper vessel via connecting means in the form of a pneumatic conveyor line provided with a discharge valve.

The batch load of fly ash is held in the stripper vessel while a continuous flow of low-pressure nitrogen into the bottom of the stripper and up through the batch of fly ash in the vessel is maintained. The flow of nitrogen gas strips the synthesis gas from the fly ash with the gases being discharged through an open valve in a vent line from the top of the stripper vessel. The batch is treated this way in the stripper vessel until the content of carbon monoxide in the discharged gas has dropped to below a pre-determined value. Then the batch of fly ash is released for disposal.

In the above described apparatus and method, fresh fly ash must be collected into a new batch during the time that the prior batch is being stripped in the stripper vessel.

This poses a certain minimum amount of powder that has to be collected in each batch load. To this end, the above described apparatus and method make use of an intermediate accumulating capacity provided by an accumulator in the form of an intermediate collecting vessel and/or a lower part of the separator and/or a lock hopper, or a combination of those.

SUMMARY OF THE INVENTION

The invention provides a system for removal of a toxic gas from a powder contaminated with the toxic gas, which system comprises:

- a source of the contaminated powder;
- a stripper assembly for stripping at least part of the toxic gas from a batch load of the contaminated powder;
- connecting means for fluidly connecting the source with the stripper assembly for transporting the contaminated powder from the source to the stripper assembly;

wherein the stripper assembly comprises two or more stripper vessels, and the connecting means is arranged to selectively connect the source to one or more of the stripper vessels.

For the purpose of this specification, the term "to selectively connect" is understood to mean selecting one or more stripper vessels out of the two or more stripper vessels and connecting the source of contaminated powder to the thus selected stripper vessels.

In accordance with the invention there is also provided a method of de-toxicating a powder contaminated with a toxic gas, wherein de-toxicating comprises at least partially removing the toxic gas from the contaminated powder, and the method comprises the steps of:

- providing a stripper assembly;
- transporting the contaminated powder from the source to the stripper assembly;
- stripping at least part of the toxic gas from a batch load of the contaminated powder in the stripper assembly;

wherein the provided stripper assembly comprises two or more stripper vessels and wherein transporting the contaminated powder from the source to the stripper assembly includes:

- selecting one or more of the stripper vessels; and
- transporting the contaminated powder to the selected one or more stripper vessels.

Simultaneously to these steps, an earlier batch load of the contaminated powder can be in the course of being stripped from the toxic gas in an unselected stripper vessel.

The source may be provided with collecting means for collecting an amount of contaminated powder prior to discharging the collected contaminated powder to the stripper assembly.

Such collecting means can be provided in the form of a collecting vessel or a collecting hopper. Preferably, the collecting means is provided in the form of a sluice vessel for sluicing the batch load from a first pressure to a second pressure different from the first pressure.

In an attractive embodiment, the connecting means is arranged to establish gravity-driven transport of the batch load from the source, or if provided the collecting means, to the stripper assembly. Herewith it is achieved that transport of the batch loads does not rely on the presence of a pneumatic conveyor line.

It will be clear that this advantage of gravity-driven transport is also achieved in a system wherein the stripper assembly consists of only one stripper vessel, and the connecting means is arranged to connect the source, or if provided the collecting means, to that stripper vessel.

In practice, gravity-driven transport of the batch load from the source to the stripper assembly can be achieved by locating the source of the contaminated powder gravitationally higher than the stripper assembly. When this is combined with the above-described system, the vertical construction can be made lower and lighter thanks to the smaller batch loads to be treated than is the case with a single stripper vessel line-up.

BRIEF DESCRIPTION OF DRAWINGS

The invention will described hereinafter in more detail and by way of example, with reference to the accompanying drawings in which.

DETAILED DESCRIPTION OF THE INVENTION

In the Figures like reference signs relate to like components.

Although the system in accordance with the invention can find application in other fields of technology, the system and its operation will be described as part of a gasification plant by way of example.

Figure 1:
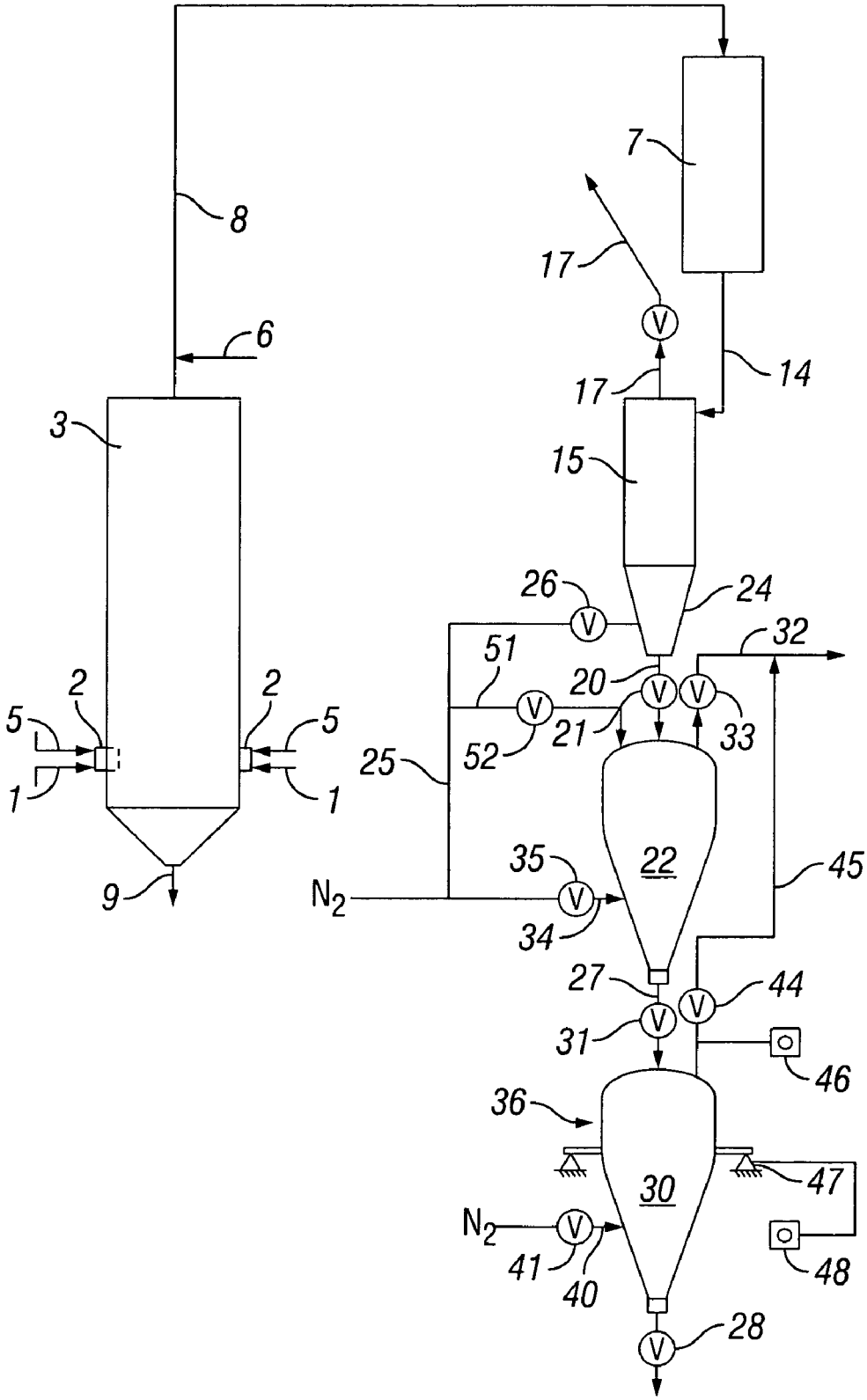
FIG. 1 schematically shows part of a gasification plant based on gravity-driven transport of fly ash.

Referring to FIG. 1 there is schematically shown a fly-ash separation section in a coal gasification plant, comprising a gravity driven transport arrangement of fly ash through a treatment system for the removal of a toxic gas.

A reactor in the form of gasifier 3 is provided for the generation of synthesis gas. In a coal gasification plant this generally occurs by partially combusting a carbonaceous fuel, such as coal, at relatively high temperatures in the range of 1000° C. to 3000° C. and at a pressure range of about 1 to 70 bar, preferably 7 to 70 bar, in the presence of oxygen or oxygen-containing gases in the coal gasification reactor. The gasifier 3 may be a vertical oblong vessel, preferably cylindrical in the burner area, with substantially conical or convex upper and lower ends, and is defined by a surrounding membrane wall structure (not shown) for circulation of cooling fluid. Typically, the gasifier will have burners 2 in diametrically opposing positions, but this is not a requirement of the present invention.

In operation, oxygen is introduced to the burners 2 via line 5 and powdered coal via line 1. Slag is collected and cooled in a slag bath in the bottom of the gasifier 3 and discharged via line 9. Hot raw synthesis gas leaves the gasifier 3 at a temperature of between about 1250° C. to about 1750° C., through a straight elongated quench line 8 of selected length. The interior of the quench line 8 forms a quench chamber in which the raw synthesis gas and the fly ash and impurities carried thereby are quenched, preferably by introduction into the quench line of cooler synthesis gas through line 6 from any suitable point in the process. The quench gas may be from 150° C. to about 550° C. The quenched gas then passes to a cooler 7 or heat exchanger 7. Heat exchanger 7 is preferably a multiple section exchanger, the quenched synthesis gas being cooled by fluid in the tubes, and operates at substantially the same pressure as the gasifier.

The raw synthesis gas, now cooled in the low temperature section of heat exchanger 7 to a temperature of about 400° C. to about 200° C., passes via line 14 to a gas-particulate separator 15, preferably in the form of a high-temperature high-pressure filter for removing fly ash particles, such as a cyclone separator, a candle filter, or one or more of each in sequence.

The synthesis gas passes through the gas-particulate separator 15 and clean gas exits via line 17 as product gas, leaving behind the fly ash that was previously entrained in the synthesis gas stream.

In a continuous gasification process, a fairly continuous stream of dry solid fly ash particulates is expected to be separated from the synthesis gas in the separator 15. The bottom 24 of the gas-particulate separator 15 may be designed as an accumulator, thereby acting as a collecting vessel for collecting a batch load of the contaminated fly-ash powder. A separate intermediate collecting vessel may also be provided displaced from the gas-particulate separator 15, to which the dry solid fly ash separated from the synthesis gas is discharged.

When an intermediate batch of the fly ash particulates has been collected in the accumulator and/or the collecting vessel, it is discharged through line 20, through open valve 21 into a sluice vessel in the form of a pressure-isolatable lock hopper 22.

The sluice vessel 22 may be used as a collecting vessel to collect one batch load of the fly-ash particulates. It is also possible for the sluice vessel 22 to function as the only collecting vessel, acting as accumulator for receiving the fairly continuous stream of fly-ash from the separator.

The sluice vessel 22 is employed as a depressurising chamber between the high-pressure side of the present fly ash handling system and the low-pressure side which is downstream of the sluice vessel 22. In normal operation, when the valve 21 in the discharge line 20 is opened a pre-selected amount of fly ash can drop or be conveyed into the top of the sluice vessel 22 which is charged with a gas, such as nitrogen, to substantially the same pressure as the high-pressure side of the system.

During filling of the sluice vessel 22, an aerating gas such as nitrogen is provided through line 25 and valve 26. Injecting gas into the bottom of the accumulator 24, as well as the rest of the vessels in the system, helps to fluff up the fly ash in the vessel and break it loose from the cone-shaped bottom of the vessel. This is known in the art as aerating.

The sluice vessel 22 is connected to a stripper assembly 36 by means of connecting means comprising a discharge or transfer line 27 with a discharge valve 31, through which the batch load of fly ash from the sluice vessel 22 is transported to the top of a stripper vessel 30 which is part of the stripper assembly 36.

For the purpose of this specification, the part of the gasification plant described above and upstream of the connecting means, is considered as the source of the contaminated powder. Many variations to the described source of the contaminated powder are possible.

In the system as it is shown in FIG. 1, the stripper assembly 36 contains a single stripper vessel 30. The sluice vessel 22 is also provided with a vent line 32 and valve 33 whereby the sluice vessel can be depressurised from its high-pressure mode to its low-pressure mode being substantially atmospheric pressure. The sluice vessel is also provided with a nitrogen supply line 34 having a valve 35 therein and being connected to a nitrogen supply source, for aeration. Also, a flow of nitrogen is maintained through line 34 and valve 35 to keep the load in the sluice vessel 22 fluffy as long as possible.

In the operation of the sluice vessel 22, with it being empty, valves 21, 31, 33, 35 and 52 are closed prior to opening valve 52 in the nitrogen supply line 51. Valve 52 is opened and the empty sluice vessel 22 is pressurized to a pressure substantially equal to that of the feed line 20. Valve 52 is then closed and fly ash supply valve 21 is opened and an amount of fly ash is dropped into the sluice vessel 22. Optionally, valve 35 in nitrogen supply line 51 is opened while dropping the fly ash, in order to keep the fly ash as fluffy as possible.

If there is not sufficient fly ash in the sluice vessel 22 at that time to form a batch load for transporting to the stripper assembly 36, valve 21 in line 20 would be kept open until sufficient fly ash had been collected in the sluice vessel 22.

In order to bring the sluice vessel 22, now containing a batch load of the fly-ash, from its high-pressure mode to its low-pressure mode, supply line valve 21 would be closed and vent valve 33 would be opened to bleed the gas through line 32 until the sluice vessel is substantially at atmospheric pressure. The gas or gases from line 32 can be sent to a flare (not shown). At this point, the fly ash discharge valve 31 is opened allowing the batch load to drop into the stripper vessel 30. To this end, the sluice vessel 22 is located gravitationally higher than the stripper vessel 30.

With the entire charge of fly ash transferred from the sluice vessel 22 to the stripper assembly 36, valves 21, 31, 33 and 35 are closed and valve 52 in the nitrogen supply line 51 is opened to a high pressure nitrogen source to bring the sluice vessel 22 again to its high pressure mode. With the pressures within the sluice vessel 22 and the gas-particulate separator 15 substantially equal, the operation of the sluice vessel is repeated with a subsequent charge of fly ash.

Still referring to FIG. 1, as a batch of fly ash moves from the gas-particulate separator 15 to the sluice vessel 22 and thence on to the stripper assembly 36, a minor amount of synthesis gas is carried by, entrained with or adsorbed on the body of fly ash. To remedy this undesirable situation and to detoxify the body of fly ash, the stripper assembly is provided with purge means arranged to supply a purge fluid to the batch load of fly ash. In the system of FIG. 1, this is embodied in the form of a continuous flow low-pressure nitrogen flowing through line 40 and open valve 41, into the bottom of the stripper vessel and up through the batch load of fly ash present in the stripper vessel. At this time the inlet valve 31 is closed and a fly ash discharge valve 28 fluidly connected to discharge line 43 (shown in FIG. 2) is closed.

The flow of nitrogen up through the batch load of fly ash in the stripper vessel 30 strips the synthesis gas from the fly ash with the gases being discharged through an open valve 44 in a vent line 45 from the top of the stripper. The carbon monoxide content of the gases vented through line 45 is preferably measured and monitored by a carbon monoxide analyzer and recorder 46 of any type well known to the art. When the carbon monoxide in the gas being vented to a flare drops below a predetermined value, say, 10 ppmv, the valve 41 in the stripping nitrogen line 40 is closed. Weigh cells 47 and its recorder 48 can be provided on the stripper vessel for measuring and recording the gross weight after it has stabilized.

The stripper vessel 30 is then-isolated from the flare line by closing valve 44. The fly ash discharge valve 28 is then opened upon which the stripped load is discharged for any kind of subsequent disposal which may include temporary storage in a storage silo. At this point, the temperature of the fly ash may be below 100° C. Any disposal or desired use of the fly ash may be made.

As remarked above, the system as depicted in FIG. 1 has a stripper assembly 36 provided with a single stripper vessel 30. However, it is preferred to provide the stripper assembly with two or more stripper vessels for parallel operation as will now be elucidated in more detail with reference to FIG. 2.

Figure 2:
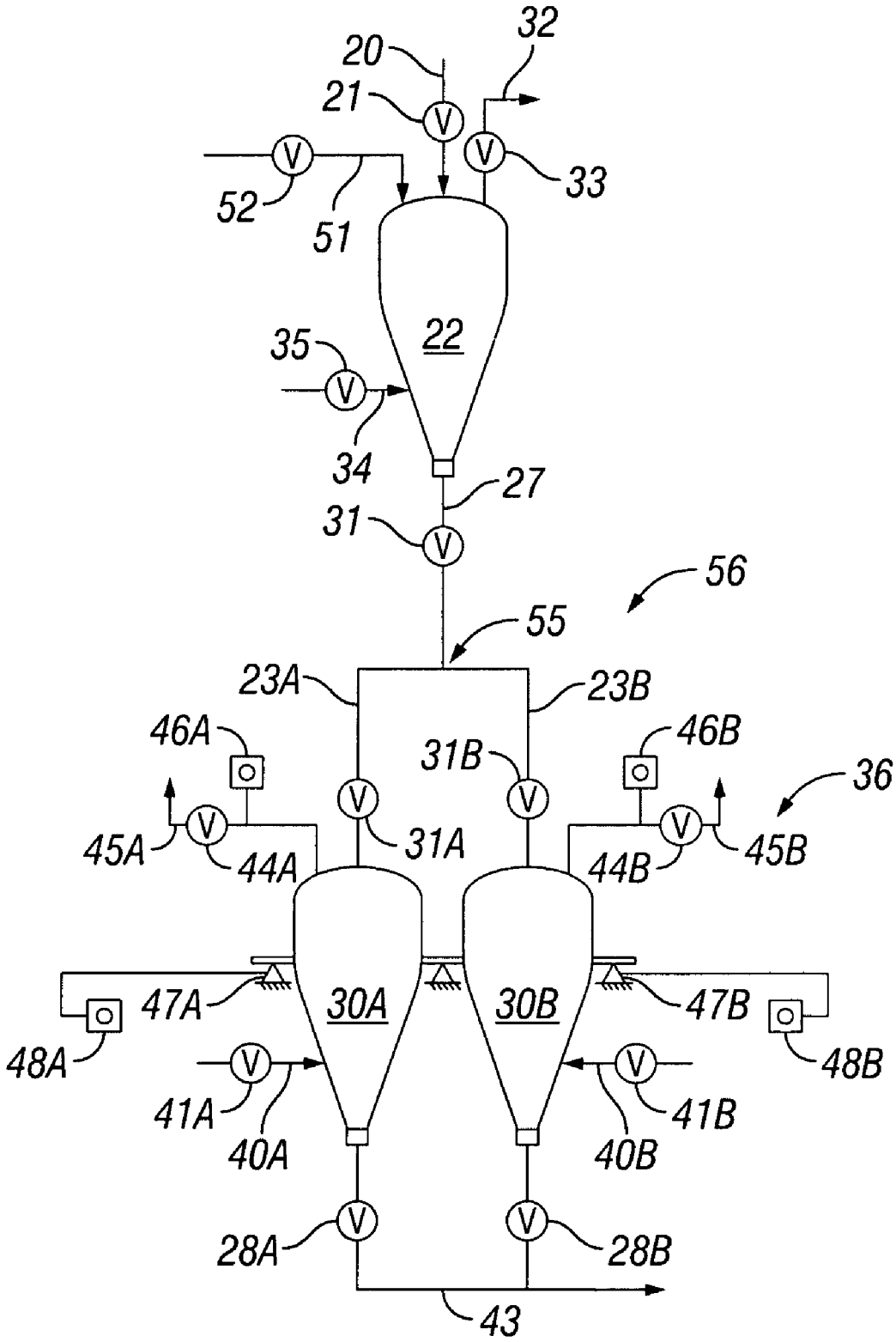
FIG. 2 schematically shows a system for removing synthesis gas from fly ash involving parallel stripping vessels.

FIG. 2 shows the preferred system for removing synthesis gas from fly ash. This system is characterised by the stripper assembly 36 comprising two or more stripper vessels 30A and 30B, which allows for parallel stripping of fly ash. This stripper assembly can replace the stripper assembly shown in FIG. 1.

In the same way as in FIG. 1, the collecting vessel provided in the form of sluice vessel 22, which connects to fly ash supply line 20 having valve 21. In the same way as FIG. 1, a vent line 32 with valve 33 is provided, as well as nitrogen supply lines 34 and 51 having valves 35 and 52 therein. On a lower end, the sluice vessel 22 is provided with connecting means 56 fluidly connecting the sluice vessel 22 with the stripper assembly 36.

The connecting means 56 comprises discharge line 27 with valve 31 therein, which fluidly connects to a split branch unit 55 forming its main arm conduit protruding gravitationally upward from the branch unit 55. Gravitationally downward from the branch unit 55 are provided two distributor arm conduits 23A and 23B that connect to the stripper vessels 30A and 30B, respectively. The distributor arm conduits 23A and 23B are provided with valves 31A and 31B. Similar to FIG. 1, the stripper vessels 30A and 30B are dischargeable to transport line 43, via discharge lines and controlled by valves 28A and 28B provided in the discharge lines. Transport line 43 may lead to a storage silo or any alternative disposal facility.

The sluice vessel 22 is operated as described above with reference to FIG. 1. Before discharging the batch load into the stripping assembly 36, one of the stripper vessels 30A or 30B is selected. Then, not only valve 31 but also valve 31A or 31B provided in the distributor arm conduits is opened in accordance with the selection in order to transport the batch load into the selected stripper vessel 30A or 30B.

Apart from their sizes, the stripper vessels 30A, 30B can be functionally similar to the stripper vessel 30. In particular, they can each be provided one or more of a nitrogen supply line (40A, 40B) and valves (41A, 41*b*) and weigh cells (47A, 47B) and its recorders (48A, 48B). Vent lines 45A and 45B are provided in the top of each of the stripper vessels 30A and 30B, and may vent gases from the stripper vessels to a flare (not shown). The carbon monoxide content of the gases vented through lines 45A and 45B is preferably measured and monitored by a carbon monoxide analyzer and recorder in the same way as explained above with reference to FIG. 1.

A complete cycle can be as follows. The first batch is collected, and depressurised in the sluice vessel 22. Stripping vessel, 30A is selected, and valves 31 and 31A are opened in order to transport the batch load of contaminated fly ash to stripper vessel 30A. Then valves 31 and 31A are closed, and the contaminated fly ash is stripped from the synthesis gas, for instance by purging in the same way as described above.

In the meantime, the sluice vessel 22 is brought into its high-pressure condition as described above, and a second batch is prepared for transport to the stripper assembly 36. After depressurisation in the sluice vessel 22, stripping vessel 30B is selected, and valves 31 and 31B are opened in order to transport the second batch load of contaminated fly ash to stripper vessel 30B. Then valves 31 and 31A are closed, and the contaminated fly ash is stripped from the synthesis gas, for instance by purging in the same way as described above.

Still in the meantime, the sluice vessel 22 is again brought into its high-pressure condition and a third batch load is prepared for transport to the stripper assembly 36. Before transport of the third batch load to the stripper-assembly, the stripping of the first batch load in stripper vessel 30A must be terminated and the stripper vessel 30A released from the first batch load, which can be done in the same way as described above with reference to FIG. 1. Then stripper vessel 30A can be selected for the second time, and the cycle is repeated.

In comparison to the system of FIG. 1, the cycling frequency of the sluice vessel is approximately twice as high (disregarding "dead time" due to disconnecting and connecting the source to a new stripper vessel and/or pressurizing/depressurising the sluice vessel). Since in principle the production of fly-ash containing product gas is not affected by this dry solids removal line up, the load capacity of the sluice vessel 22 can be approximately halved. Also, the load capacity of the stripping vessels 30A and 30B can be approximately halved. Particularly when employing gravity-driven transport between the sluice vessel 22 and the stripper assembly 36, this is of great advantage because the vertical construction needs to be less tall and is can be much lighter since the loads to be supported are significantly lower.

Thus, the system according to the invention is also advantageous if the source is provided with collecting means for collecting an amount of contaminated powder prior to discharging the collected contaminated powder to the stripper assembly via the connecting means, because in that case the required accumulating capacity for the intermediate collecting vessel is reduced in comparison with a system comprising only one stripper vessel.

This is clarified in the following way. In operation, the first batch load can be stripped in a first one of the stripper vessels while at the same time:

- a second batch load is being collected in the collecting vessel and transported to another stripper vessel in the stripper assembly; and subsequently
- a third batch load is being collected in the collecting vessel for later transportation to said first one of the stripper vessels.

When, for example, two stripper vessels are in use, the available dwell time, or residence time, of a batch load in the first one of the stripper vessels is thus approximately (disregarding time required to establish a new connection) twice the time required for collecting a new batch. Assuming that the dwell time required for sufficiently stripping a batch load is not affected by the invention, the batch size can thus be approximately half of what would be the case when only one stripper vessel is available for use.

Consequently, the accumulating capacity can be reduced, or the provided collecting means can be reduced in size.

In an alternative embodiment, the provision of two parallel stripper vessels allows in principle for omitting a collecting vessel located in series with the stripper assembly. In that case, one of the stripper vessels 30A or 30B assumes the function of collecting a new batch load of contaminated powder while a previous batch load is being stripped in another of the stripper vessels. Since the stripper assembly comprises two or more stripper vessels, which are selectively connectable to the source of contaminated powder, it is now possible to strip a first batch load in a first one of the stripper vessels while more contaminated powder, for a second batch load, passes through the connecting means to another stripper vessel. Thus, an intermediate accumulating capacity for collecting the second batch load is not needed, or can at least be reduced. It should be noted that a small accumulating capacity may still be needed to allow for a short period of time that may be necessary to disconnect the source from a previously connected stripper vessel and connect the source to a newly selected stripper vessel. Small adaptations may have to be made to the stripper vessels 30A and 30B if they are also to be used for sluicing the batch loads from one pressure state to another pressure state.

An automated control system is used in carrying out the fly ash collection and stripping sequences of the present invention, due to the complexity of the operation and the large number of steps which must be performed, some simultaneously and some in rapid succession. A programmable logic controller confirms when the sluice vessel 22 has been emptied and isolated from the stripper assembly 36.

In order to position the stripper vessels 30A and 30B side by side, at least one of the two distributor arm conduits (23A and/or 23B) comprises a slanted section extending over a non-vertical trajectory. For any non-vertical angle, the efficiency for gravity-driven transport is hampered. To prevent compaction of the fly ash in the distributor arms and to enhance gravity-driven transport of the fly ash through the distributor arms, aeration means can be provided for aerating the slanted section. This can be done by maintaining a purge flow of nitrogen into the distributor arm.

Preferably, the slanted section extends under an angle of between 1° and 30° from the vertical. When the angle is higher than 30° the vertical component of the gravitational pull on the fly ash becomes too low for effective gravitational driven transport. However, when the angle is too small, a large separation is required between the sluice vessel 22 and the stripper assembly 39. These effects are balanced optimally when the angle with the vertical for each of the distributor arms is between 12° and 20°. In the embodiment of FIG. 2, the angle is 15° for both distributor arms.

Any one of the valves in the systems described above which is intended for controlling the passage of dry solid fly ash particulates is preferably provided in the form of a ball valve.

If desired some stripping operations may take place in the sluice vessel using nitrogen flow after it has been depressurised.

We claimed:

1. A system for removal of a toxic gas from a fly ash powder contaminated with the toxic gas, the system comprising:

- a source of the contaminated fly ash powder;
- a stripper assembly for stripping at least part of the toxic gas from a batch load of the contaminated fly ash powder;
- connecting means for fluidly connecting the source with the stripper assembly for transporting the contaminated fly ash powder from the source to the stripper assembly;
- wherein the stripper assembly comprises two or more stripper vessels, and the connecting means is arranged to selectively connect the source to one or more of the stripper vessels.

2. The system of claim 1, wherein the source comprises collecting means for collecting contaminated fly ash powder prior to discharging the collected contaminated fly ash powder to the stripper assembly via the connecting means.

3. The system of claim 2, wherein the collecting means is arranged to collect the batch load of the contaminated fly ash powder.

4. The system of claim 2, wherein the collecting means is provided in the form of a collecting vessel or a collecting hopper.

5. The system of claim 2, wherein the collecting means is provided in the form of a sluice vessel for sluicing the batch load from a first pressure to a second pressure different from the first pressure.

6. The system of claim 1, wherein the stripper assembly is provided with purge means arranged to supply a purge fluid to the batch load.

7. The system of claim 1, wherein the connecting means is arranged to establish gravity-driven transport of the batch load from the source to the stripper assembly.

8. The system of claim 1, wherein the connecting means comprises a split branch unit comprising a main arm conduit fluidly connectable to the source, and at least two distributor arm conduits each of which fluidly connectable to one of the stripper vessels.

9. The system of claim 8, wherein at least a first one of the two distributor arm conduits comprises a slanted section extending over a non-vertical trajectory.

10. The system of claim 8, wherein the distributor arm conduits are each provided with a valve, for selectively controlling transport of the fly ash powder through the respective distributor arm conduit.

11. A method of de-toxicating a fly ash powder contaminated with a toxic gas, wherein de-toxicating comprises at least partially removing the toxic gas from the contaminated fly ash powder, and the method comprises the steps of:

providing a stripper assembly;

transporting the contaminated fly ash powder from the source to the stripper assembly;

stripping at least part of the toxic gas from a batch load of the contaminated fly ash powder in the stripper assembly;

wherein the provided stripper assembly comprises two or more stripper vessels and wherein transporting the contaminated fly ash powder from the source to the stripper assembly includes:

selecting one or more of the stripper vessels; and transporting the contaminated fly ash powder to the selected one or more stripper vessels.

12. The method of claim 11, wherein, prior to the step of transporting the contaminated fly ash powder from the source to the stripper assembly, the batch load of the contaminated fly ash powder is collected in a collecting vessel, and wherein transporting the contaminated fly ash powder from the source to the stripper assembly includes transporting the contaminated fly ash powder from the collecting vessel to the stripper assembly.

13. The method of claim 11, wherein, simultaneously to said steps, a preceding batch load of the contaminated fly ash powder is being stripped in an unselected stripper vessel.

14. The system of claim 9, wherein the slanted section extends under an angle of between 1° and 30° from the vertical.

15. The system of claim 10, wherein the valve comprises a ball valve.

16. A system for removal of a toxic gas from a fly-ash-containing powder contaminated with the toxic gas, the system comprising:

a gasification reactor for producing synthesis gas;

a fly-ash separator arranged to receive fly-ash-containing synthesis gas from the gasification reactor;

a depressurising chamber arranged to receive a batch load of the fly-ash-containing powder from the fly-ash separator, and arranged to depressurise the batch load from a first pressure to a second pressure lower than the first pressure;

first connecting means for fluidly connecting the fly-ash separator with the depressurising chamber for transporting the contaminated fly-ash-containing powder from the fly-ash separator to the depressurising chamber;

a stripper assembly for stripping at least part of the toxic gas from the batch load of the contaminated fly-ash-containing powder;

second connecting means for fluidly connecting the depressurising chamber to the stripper assembly for transporting the contaminated fly-ash-containing powder from the depressurising chamber to the stripper assembly;

wherein the second connecting means is arranged to establish gravity-driven transport of the batch load from the depressurising chamber to the stripper assembly.

17. The system of claim 16, wherein the depressurising chamber is arranged gravitationally higher than the stripper assembly.

18. The system of claim 16, wherein the stripper assembly is provided with purge means arranged to supply a purge fluid to the batch load.

19. The system of claim 16, wherein the second connecting means extends vertically or comprises a slanted section extending over a non-vertical trajectory.

20. The system of claim 19, wherein the slanted section extends under an angle of between 1° and 30° from the vertical.

21. The system of claim 16, wherein the first connection means is arranged to establish gravity-driven transport of the contaminated fly ash.

22. The system of claim 21, wherein the fly-ash separator is arranged gravitationally higher than the depressurising chamber.

23. The system of claim 16, wherein the depressurising chamber is provided in the form of a sluice hopper.

24. A method of de-toxicating a fly-ash-containing powder contaminated with a toxic gas, wherein de-toxicating comprises at least partially removing the toxic gas from the contaminated fly-ash-containing powder, and the method comprises the steps of:

producing a stream of fly-ash-containing synthesis gas by partial oxidation of a carbonaceous fuel;

providing a fly-ash stripper, a depressurising chamber, and a stripper assembly;

receiving the stream of fly-ash-containing synthesis gas in the fly-ash stripper and discharging fly-ash separated from the synthesis gas in the form of the fly-ash-containing powder into the depressurising chamber;

depressurising the fly-ash-containing powder from a first pressure to a second pressure lower than the first pressure;

transporting the fly-ash-containing powder from the depressurising chamber to the stripper assembly;

stripping at least part of the toxic gas from a batch load of the fly-ash-containing powder in the stripper assembly;

wherein transporting the fly-ash-containing powder to the stripper assembly is driven by gravity.

25. The method of claim 24, wherein transporting the fly ash containing powder is achieved by dropping the fly-ash-containing powder.

26. The method of claim 24, wherein discharging fly-ash separated from the synthesis gas in the form of the fly-ash-containing powder into the depressurising chamber is driven by gravity.

27. The method of claim 24, wherein discharging fly-ash separated from the synthesis gas in the form of the fly-ash-containing powder into the depressurising chamber is achieved by dropping the fly-ash-containing powder.

28. The method of claim 24, wherein the depressurising chamber is provided in the form of a sluice vessel.

* * * * *